US009982468B2

(12) United States Patent
Mittelbach

(10) Patent No.: US 9,982,468 B2
(45) Date of Patent: May 29, 2018

(54) MOTOR VEHICLE DOOR LOCK

(71) Applicant: Kiekert Aktiengesellschaft, North Rhine-Westphalia (DE)

(72) Inventor: Stephan Mittelbach, Velbert (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 300 days.

(21) Appl. No.: 14/419,058

(22) PCT Filed: Jul. 27, 2013

(86) PCT No.: PCT/DE2013/000410

§ 371 (c)(1),
(2) Date: Feb. 2, 2015

(87) PCT Pub. No.: WO2014/019564

PCT Pub. Date: Feb. 6, 2014

(65) Prior Publication Data

US 2015/0204117 A1 Jul. 23, 2015

(30) Foreign Application Priority Data

Jul. 31, 2012 (DE) ..... 20 2012 007 326 U

(51) Int. Cl.

| | |
|---|---|
| ***E05C 3/16*** | (2006.01) |
| ***E05B 85/20*** | (2014.01) |
| ***E05B 77/04*** | (2014.01) |
| ***E05B 85/02*** | (2014.01) |
| ***E05B 85/26*** | (2014.01) |

(52) U.S. Cl.

CPC ..... *E05B 85/20* (2013.01); *E05B 77/04* (2013.01); *E05B 85/02* (2013.01); *E05B 85/26* (2013.01); *Y10T 292/1075* (2015.04)

(58) Field of Classification Search

CPC ..... Y10T 292/1075; Y10T 292/1078; Y10T 292/1082; Y10T 292/1047; E05B 77/04; E05B 85/20; E05B 85/24; E05B 85/02; E05B 85/26; E05B 85/243; Y10S 292/23

See application file for complete search history.

(56) References Cited

U.S. PATENT DOCUMENTS 6,349,983 B1 2/2002 Dupont et al.

FOREIGN PATENT DOCUMENTS

DE 10212217 A1 * 10/2003 ..... E05B 77/10
DE 10361445 A1 8/2005

(Continued)

OTHER PUBLICATIONS

Computer Generated Translation for WO 2011/110143, Generated on Dec. 4, 2017, https://worldwide.espacenet.com/ (Year: 2017).*

(Continued)

*Primary Examiner* — Alyson M Merlino
(74) *Attorney, Agent, or Firm* — Woodard, Emhardt, Moriarty, McNett & Henry LLP

(57) ABSTRACT

The invention relates to a motor vehicle door lock, having a lock case (1), and also a locking mechanism (2, 3) which is supported in the lock case (1) and consists substantially of a rotary latch (2) and a pawl (3), and having an additional reinforcing element (7), wherein the reinforcing element (7) is formed as a reinforcing plate (7) which couples the two axes of rotation of both the rotary latch (2) and the pawl (1) at a distance from the lock case (1).

17 Claims, 2 Drawing Sheets

(56) References Cited

FOREIGN PATENT DOCUMENTS

| | | | | | |
|---|---|---|---|---|---|
| DE | 102009029025 | A1 | | 3/2011 | |
| EP | 103904 | A2 | | 3/1984 | |
| EP | 0769599 | A1 | * | 4/1997 | E05B 85/243 |
| EP | 1621705 | A2 | * | 2/2006 | E05B 85/02 |
| FR | 2783551 | A1 | * | 3/2000 | E05B 1/14 |
| GB | 2360326 | A | * | 9/2001 | E05B 85/02 |
| JP | WO 2010110492 | A1 | * | 9/2010 | E05B 65/00 |
| JP | WO 2011077799 | A1 | * | 6/2011 | E05B 85/02 |
| JP | WO 2011102057 | A1 | * | 8/2011 | E05B 85/26 |
| KR | 20070078077 | A | * | 7/2007 | E05B 83/36 |
| WO | WO-2006099730 | A1 | * | 9/2006 | E05B 77/26 |
| WO | WO 2011110143 | A2 | * | 9/2011 | E05B 77/04 |

OTHER PUBLICATIONS

Machine Translation of DE102009029025A1 by Lexis Nexis Total Patent on Jan. 30, 2015.
Machine Translation of DE10361445A1 by Lexis Nexis Total Patent on Jan. 28, 2015.
Machine Translation of EP103904A2 by Lexis Nexis Total Patent on Jan. 28, 2015.

* cited by examiner z
y
x
1c
1a
8
6
3
7
2
9
5
1
8
1b
4

MOTOR VEHICLE DOOR LOCK

CROSS-REFERENCE TO RELATED APPLICATIONS

This application is the U.S. national stage application of International Patent Application No. PCT/DE2013/000410, filed Jul. 27, 2013, which claims priority of German Application No. 20 2012 007 326.5, filed Jul. 31, 2012, which are both hereby incorporated by reference.

BACKGROUND

The invention relates to a motor vehicle door lock, having a lock case, and also a locking mechanism which is supported in the lock case and consists substantially of a rotary latch and a pawl, and having an additional reinforcing element.

Motor vehicle door locks of the aforementioned design are generally arranged and fastened on or in the interior of an assigned motor vehicle door. Said motor vehicle door lock cooperates with a striker, which in most cases is located on a B-pillar of an assigned motor vehicle body. These elements together make up a motor vehicle door lock.

The lock case is generally made of metal, because the elements of the locking mechanism supported in the lock case, specifically the rotary latch and the pawl, are exposed to substantial forces, particularly during a crash, and must be capable of withstanding these forces. During a crash, it is important for the doors that are equipped with the motor vehicle door lock, in particular the side doors, to remain closed, at least during the collision. This is the only way to prevent persons, for example, from being thrown from the motor vehicle. Moreover, only if the motor vehicle doors remain closed can it be ensured that safety devices arranged therein, such as side air bags, lateral impact protection, etc., can effectively protect the passengers of the vehicle.

In the described crash situations, it is therefore imperative for the locking mechanism in conjunction with the lock case to be capable of withstanding the deceleration forces that occur in such cases, and particularly of preventing the motor vehicle door to which they are assigned from opening unintentionally. To this end, the generic prior art according to DE 10 2009 029 025 A1 proposes a motor vehicle door lock of the design described in the introductory part, in which the locking mechanism additionally comprises at least one means for transferring force to the lock case. Said means is a bolt which is fastened on the lock case and/or is arranged such that in the main latching position it extends from a lateral wall of the lock case up to the rotary latch. The bolt is arranged adjacent to the receiving slot in the lock case, so that under the described impact-type stresses, the rotary latch is pressed against the bolt. The bolt then absorbs the corresponding force, and passes it on to the lock case.

SUMMARY

In principle, the prior art has proven advantageous; however, it presupposes an additional movable element in the motor vehicle door lock in the form of the bolt. This is not only relatively costly in terms of construction, but can also lead to malfunctions. The functioning of the bolt is dependent on the fact that in the main latching position, the rotary latch is actually pressed against the bolt in question as a result of the described stresses. However, if this is not the case, for example due to deformations of the lock case or because the rotary latch is not in the main latching position, the bolt naturally cannot perform the necessary action. The object of the invention is to remedy this situation.

The object of the invention is to develop a motor vehicle door lock of this type in such a way that its crash safety is improved, and in particular, malfunctions are reliably prevented by way of a structurally simple design.

To attain this object, a generic motor vehicle door lock is characterized within the scope of the invention in that the obligatory reinforcing element is formed as a reinforcing plate which couples the two axes of rotation of both the rotary latch and the pawl at a distance from the lock case.

Within the scope of the invention, the axes of rotation of both the rotary latch and the pawl are each defined by a bearing bolt anchored in the lock case. Consequently, the rotary latch is equipped with its own rotary latch bearing bolt, and similarly, the pawl is equipped with an assigned pawl bearing bolt. In general, one end of each of the bearing bolts engages through the lock case. Moreover, in most cases the configuration is such that the other end of each bearing bolt engages through the reinforcing plate.

In most cases, the reinforcing plate is arranged coplanar to a bearing plane of the locking mechanism. As a result, the reinforcing plate is located at a distance from and within the same plane as, or coplanar to, the stated bearing plane of the locking mechanism. In this manner, the components of the locking mechanism, i.e. substantially the rotary latch and the pawl, are accommodated between the bearing plane and the reinforcing plate. In most cases, the configuration is such that the reinforcing plate and the bearing plane in combination with the bearing bolts define a supporting framework which is rectangular in cross-section. With the help of this supporting framework, during a crash, forces acting on the motor vehicle door lock according to the invention and particularly on the lock case are withstood particularly effectively, and if necessary, are transmitted into the relevant motor vehicle door and/or the motor vehicle body.

In most cases, the configuration is further such that each of the two bearing bolts is arranged along the edge of the rectangular supporting framework. This means that the two bearing bolts generally define the short sides of the rectangular supporting framework, whereas the long sides of the supporting framework in question are defined by the reinforcing plate on one side and by the bearing plane on the other side.

In general, during a crash, forces, particularly deformation forces, act on the lock case in the transverse direction of the vehicle. Since the bearing bolts are also connected to one another by the reinforcing plate according to the invention, substantial forces can be withstood. In other words, the supporting framework formed according to the invention, which is rectangular in cross-section, is easily capable of withstanding such forces in the Y-direction. The supporting framework according to the invention serves to accommodate the latch and pawl mechanism and the external actuating mechanism and to protect it in the Y-direction during a crash.

When the rotary latch is in its main latching position with the pawl dropped into place, the rectangular supporting framework in question ensures that the bearing bolts are deformed together in relation to the lock case when acted on by forces in the transverse and/or Y-direction of the vehicle, with the scope of said deformation being approximately equal due to the interconnection of the two bearing bolts with the help of the reinforcing plate. Because the position of the pawl and the rotary latch relative to one another does not change or changes only slightly, the pawl is prevented from being removed from the rotary latch and thereby releasing the previously captured striker, allowing the motor vehicle door to open unintentionally.

The lock case is generally embodied as substantially U-shaped in cross-section. It has proven advantageous for the above-described bearing plane of the locking mechanism to be formed by the center part of the lock case. One arm of the lock case and a supporting framework plane spanned by the supporting framework are generally arranged parallel to one another. The obligatory receiving slot for the striker is generally also provided in this arm of the lock case. Since the arms of the substantially U-shaped lock case are arranged substantially perpendicular to the transverse direction or Y-direction of the vehicle, with this configuration of the invention the supporting framework plane, and with it the above-described rectangular supporting framework, are also arranged perpendicular to said Y-direction. As a result, any forces in this transverse direction of the vehicle are optimally absorbed as described by the locking mechanism and/or the supporting framework, and are passed on to the lock case.

As a further distinguishing feature, the reinforcing plate can also be equipped with additional side members. In general, two side members are provided, arranged substantially parallel to one another. It has further proven advantageous for the two side members to extend substantially perpendicular in relation to the reinforcing plate. In general, the side members are connected to one another at their end faces by a respective cross member. Moreover, in most cases the configuration is such that one end of each side member extends up to one arm of the lock case, with the other end of each side member extending along the center part of the substantially U-shaped lock case and touching the second arm. Consequently, each side member also ensures that the parts of the lock case are mechanically interconnected with one another, specifically by means of one or both side members. In this manner, the two arms and the center part of the lock case are also reinforced relative to one another.

This mechanical coupling and reinforcement of the two arms of the substantially U-shaped lock case is improved further by forming the respective side member or both side members as L-shaped in cross-section, as compared with the substantially U-shaped lock case. This means that the long L-arm of the side member extends up to the one arm of the lock case. In contrast, the short L-arm of the side member stands vertically in relation to the center part of the lock case, and touches the second arm of the lock case. The reinforcing plate and the respective side members, in conjunction with the lock case, thus together define a bearing cage for the locking mechanism. This bearing cage is advantageously capable of withstanding forces acting predominantly on the locking mechanism in the Y- or transverse direction of the vehicle, but also forces in the X- or longitudinal direction of the vehicle. Moreover, this configuration also ensures that forces that occur less frequently, in the vertical axis or the Z-direction of the vehicle, can also be overcome.

As a result, a motor vehicle door lock is provided, which has a lock case having a particularly sturdy design and a corresponding locking mechanism. The reinforcing plate provided at this location ensures primarily that the bearing bolts for the rotary latch and for the pawl are not only mechanically connected to one another via the lock case, but are also reinforced by the additional reinforcing element. In a particularly advantageous embodiment, one or two additional side members are also provided.

With the use of said side members, the reinforcing plate, in conjunction with the side members and the lock case, together define a bearing cage for the locking mechanism. As a result, deformation forces that are exerted during a crash, even those that previously could not be withstood, can be absorbed without the locking mechanism opening up unintentionally and releasing a previously captured striker, thereby allowing the motor vehicle door to open up. The passengers inside the vehicle are therefore optimally protected during a crash. These are considered to be the essential advantages.

BRIEF DESCRIPTION OF THE DRAWINGS

In the following, the invention will be specified in greater detail in reference to a set of drawings representing only one embodiment; the drawings show.

DETAILED DESCRIPTION OF THE DRAWINGS

Figure 1:
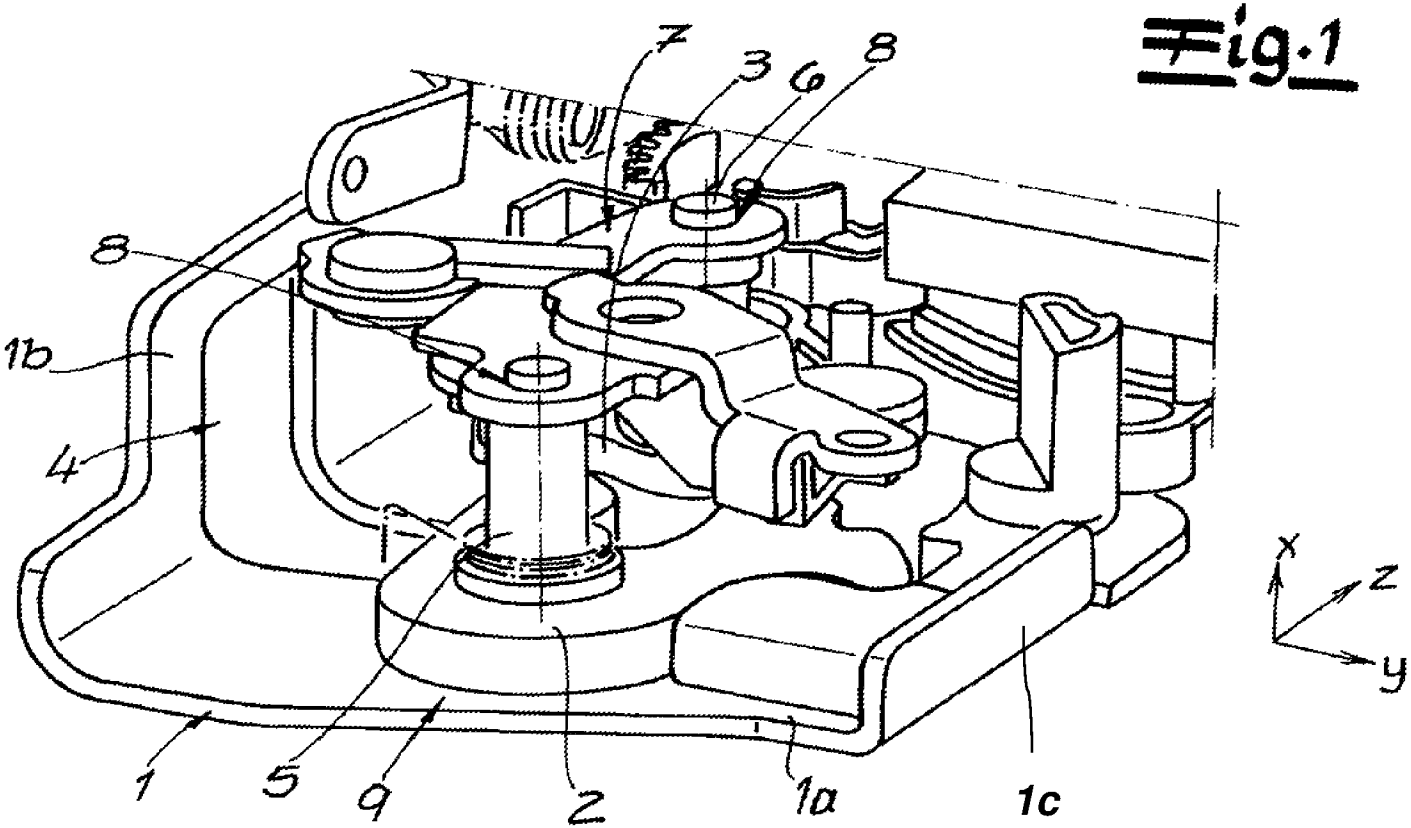
FIGS. 1 and 2 various configurations of a motor vehicle door lock according to the invention.
Figure 2:
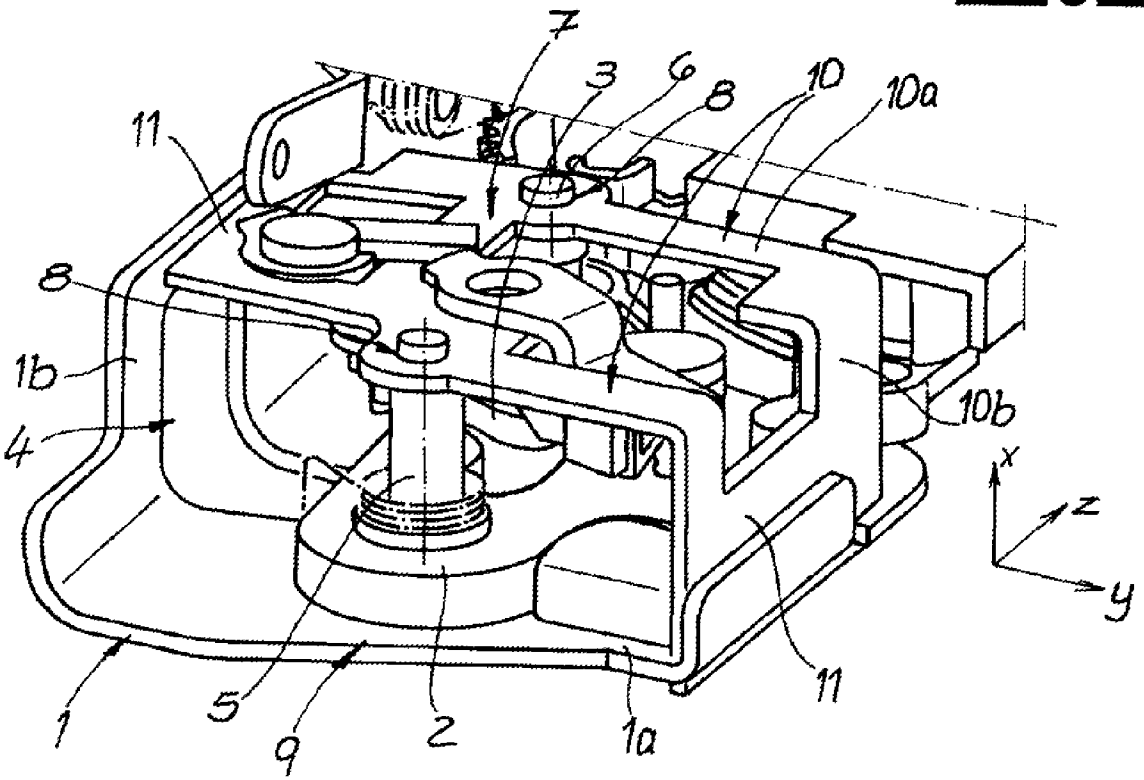

The motor vehicle door lock represented in FIGS. 1 and 2 is equipped with a lock case 1 made of metal, in particular steel. Also represented is a locking mechanism 2, 3 comprising substantially a rotary latch 2 and a pawl 3. With the help of the rotary latch 2, a striker, which is not shown and is attached, for example, to a B-pillar of a motor vehicle body, is captured, said striker descending into the locking mechanism 2, 3 via a receiving slot or a receiving opening 4, and being released again when the locking mechanism 2, 3 is opened. This is the standard functioning method, and therefore will not be described in any greater detail in this context.

The rotary latch 2 and the pawl 3 are each supported in the lock case 1. For this purpose, the lock case 1 is equipped with bearing bolts 5, 6 anchored therein, which define respective axes of rotation for the rotary latch 2 and the pawl 3.

Actually, bearing bolt 5 is a rotary latch bearing bolt 5, on which rotary latch 2 is rotatably mounted. Bolt 6 is embodied and provided as a pawl bearing bolt 6 for the rotatable mounting of pawl 3. Both bearing bolts 5, 6 are anchored in lock case 1, and extend with one end through lock case 1. The other end of each of bearing bolts 5, 6 extends through a reinforcing plate 7.

Reinforcing plate 7 represents a reinforcing element 7, which couples the axes of rotation of both rotary latch 2 and pawl 3 with one another, at a distance from lock case 1. Actually, each of the bearing bolts 5, 6 is equipped with a groove 8 at its head end, with the help of which the reinforcing element or reinforcing plate 7 is positioned in relation to the bearing bolt 5, 6 and held in place on the relevant bearing bolt 5, 6 at a distance from lock case 1. The reinforcing plate 7 is arranged as coplanar to, i.e. in the same plane as, a bearing plane 9.

It is clear that, within the scope of the two embodiments according to FIGS. 1 and 2, lock case 1 is designed as substantially U-shaped in cross-section. Actually, lock case 1 is equipped with a center part 1*a*, an arm 1*b* and an arm 1*c*. Bearing plane 9 is formed by the center part 1*a* of the substantially U-shaped lock case 1. As has already been described, reinforcing plate 7 is arranged as coplanar with, i.e. in the same plane as, said bearing plane 9, and therefore as coplanar with the center part 1*a* of the substantially U-shaped lock case 1.

The reinforcing plate 7 and the bearing plane 9, in conjunction with the two bearing bolts 5, 6, define a supporting framework 5, 7, 6, 9 which is rectangular in cross-section. This rectangular framework 5, 7, 6, 9 spans a supporting framework plane, which extends substantially parallel to arm 1*b* of lock case 1. Moreover, the two bearing bolts 5, 6 are each arranged along the edge of said rectangular supporting framework 5, 7, 6, 9, and therefore define the short sides of said rectangle. The long sides, in contrast, are formed by reinforcing plate 7 and bearing plane 9 or by center part 1*a* and arm 1*c*. The aforementioned supporting framework plane and arm 1*b* of the lock case are arranged substantially parallel to one another. This results in particularly favorable kinematics.

As a result, any deformation forces acting on the lock case in the transverse or Y-direction of the vehicle can be withstood more or less easily. If, under such deformation forces, for example during a crash, the locking mechanism 2, 3 is located in its main latching position as represented in the figures, this position will be substantially maintained because the respective bearing bolts 5, 6 are additionally aligned and anchored relative to one another by means of the reinforcing plate 7.

In a lateral impact and under the deformation forces in the transverse or Y-direction of the vehicle associated with this, the locking mechanism 2, 3 will not open unintentionally. This is because such forces are absorbed by the supporting framework 5, 7, 6, 9 in such a way that the associated bearing bolts 5, 6 undergo aligned deformations in this Y-direction, which generally do not correspond to an unintended opening of the locking mechanism 2, 3. In addition, any forces in the longitudinal direction of the vehicle or along the vertical axis or in the Z-direction of the vehicle are reliably absorbed and overcome by the rectangular supporting framework 5, 7, 6, 9 in question.

Within the scope of the developed variant according to FIG. 2, reinforcing plate 7 is also equipped with additional side members 10. These additional side members 10 are arranged substantially parallel to one another. Moreover, the side members 10 in question extend substantially perpendicular in relation to reinforcing plate 7, which connects the two side members 10 to one another. As is further clear from FIG. 2, the two side members 10 are connected to one another at their respective ends by a respective cross member 11.

The two side members 10 extend at one end up to arm 1*b*, with the other end of each side member extending along center part 1*a* and up to the second arm 1*c* of substantially U-shaped lock case 1. In this case, the side members 10 are embodied as L-shaped in cross-section, in contrast to the substantially U-shaped lock case 1. In this manner, the long L-arm 10*a* of the respective side member 10 extends up to arm 1*b* of lock case 1, whereas the short L-arm 10*b* of the L-shaped side member 10 stands vertically in relation to the center part 1*a* of the L-shaped lock case 1, and touches arm 1*c*.

The lengths of the respective arms 1*a*, 10*b* on one side and those of center part 1*b* and arm 10*a* on the other side are adapted to one another, so that reinforcing plate 7 in conjunction with side members 10 and lock case 1, together define a bearing cage 1, 7, 10 for the locking mechanism 2, 3. This bearing cage 1, 7, 10 is capable of absorbing deceleration forces acting on the locking mechanism 2, 3 or the respective bearing bolts 5, 6 in any (three-dimensional) direction, without the position of the rotary latch 2 and the pawl 1 relative to one another being altered substantially, so that in practical terms, the locking mechanism 2, 3 will not open unintentionally. As a consequence, safety during a crash is increased tremendously, while at the same time, the stability of the lock case 1 is increased significantly over that of previous designs.

The invention claimed is:

1. A motor vehicle door lock comprising, a lock case, wherein the lock case includes a center part having a first arm that extends away from the center part and a second arm that extends away from the center part, wherein the first and second arms extend away from the center part in the same direction;

a locking mechanism which is supported in the lock case, wherein the locking mechanism is directly mounted to the center part and comprises a rotary latch and a pawl; and a reinforcing plate, wherein the reinforcing plate couples two axes of rotation of both the rotary latch and the pawl at a distance from the lock case, wherein at least a portion of the reinforcing plate is arranged parallel to the center part;

wherein one of the first and second arms of the lock case and a supporting framework plane spanned by the reinforcing plate are arranged substantially parallel to one another;

wherein the reinforcing plate has side members; and wherein each of the side members extend at one end up to the first arm and at another end are connected to one another by a cross member that touches the center part.

2. The motor vehicle door lock according to claim 1, wherein each axis of rotation is defined by a bearing bolt anchored in the center part of the lock case.

3. The motor vehicle door lock according to claim 2, wherein each of the bearing bolts engages at one end through the center part of the lock case and at another end through the reinforcing plate.

4. The motor vehicle door lock according to claim 2, wherein the reinforcing plate is arranged parallel to a bearing plane of the locking mechanism and the bearing plane is parallel to the center part.

5. The motor vehicle door lock according to claim 4, wherein the reinforcing plate and the center part, in conjunction with the bearing bolts define a supporting framework that is rectangular in cross-section.

6. The motor vehicle door lock according to claim 5, wherein both of the bearing bolts are arranged along edges of the supporting framework or are arranged as short sides thereof.

7. The motor vehicle door lock according to claim 1, wherein the side members are arranged substantially parallel to one another, and extend predominantly perpendicular in relation to at least another portion of the reinforcing plate.

8. The motor vehicle door lock according to claim 1, wherein the side members are connected to one another at respective ends by a respective cross member.

9. The motor vehicle door lock according to claim 1, wherein the side members are formed as an L-shape in cross-section in such a manner that a long arm of the L-shaped cross-section of each side member extends up to the first arm and a short arm of the L-shaped cross-section of each side member is perpendicular to the center part, and the short arms of the side members are connected to each other by a cross member that touches the second arm.

10. The motor vehicle door lock according to claim 1, wherein the reinforcing plate with the side members, in conjunction with the lock case, defines a bearing cage for the locking mechanism.

11. The motor vehicle door lock according to claim 1, wherein the lock case is made of metal or steel.

12. The motor vehicle door lock according to claim 1, wherein the lock case is a monoblock or monolithic or one-piece part or component.

13. The motor vehicle door lock according to claim 2, wherein the lock case is made of metal or steel.

14. The motor vehicle door lock according to claim 2, wherein the lock case is a monoblock or monolithic or one-piece part or component.

15. The motor vehicle door lock according to claim 4, wherein the reinforcing plate has an L-shaped cross-section.

16. A motor vehicle door lock comprising, a lock case, wherein the lock case includes a center part having a first arm that extends away from the center part and a second arm that extends away from the center part, wherein the first and second arms extend away from the center part in the same direction;

a locking mechanism which is supported in the lock case, wherein the locking mechanism is directly mounted to the center part and comprises a rotary latch and a pawl; and a reinforcing plate, wherein the reinforcing plate couples two axes of rotation of both the rotary latch and the pawl at a distance from the lock case, wherein at least a portion of the reinforcing plate is arranged parallel to the center part;

wherein one of the first and second arms of the lock case and a supporting framework plane spanned by the reinforcing plate are arranged substantially parallel to one another;

wherein the reinforcing plate has side members;

wherein the side members are arranged substantially parallel to one another, and extend predominantly perpendicular in relation to at least another portion of the reinforcing plate;

wherein the side members are connected to one another at respective ends by a respective cross member; and wherein each of the side members extend at one end up to the first arm and the cross member touches the center part.

17. A motor vehicle door lock comprising, a lock case, wherein the lock case is equipped with a center part, a first arm, and a second arm, wherein the first and second arms extend away from the center part in the same direction;

a locking mechanism which is supported in the lock case, wherein the locking mechanism is directly mounted to the center part and comprises a rotary latch and a pawl; and a reinforcing plate, wherein the reinforcing plate couples two axes of rotation of both the rotary latch and the pawl at a distance from the lock case, wherein at least a portion of the reinforcing plate is arranged parallel to the center part, wherein the reinforcing plate and the center part, in conjunction with two bearing bolts, define a supporting framework which is rectangular in cross-section, wherein a length dimension of the rectangular cross-sectional shape of the supporting framework spans a supporting framework plane, which extends substantially parallel to the first arm;

wherein the reinforcing plate has side members;

wherein each of the side members extend at one end up to the first arm and at another end are connected to one another by a cross member that touches the center part.

* * * * *